US010034101B2

(12) United States Patent
Zhang

(10) Patent No.: US 10,034,101 B2
(45) Date of Patent: Jul. 24, 2018

(54) MICROPHONE

(71) Applicant: Jinyu Zhang, Shenzhen (CN)

(72) Inventor: Jinyu Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/416,084

(22) Filed: Jan. 26, 2017

(65) Prior Publication Data

US 2018/0115837 A1 Apr. 26, 2018

(30) Foreign Application Priority Data

Oct. 25, 2016 (CN) ..... 2016 2 1164347 U

(51) Int. Cl.
*H04R 19/04* (2006.01)

(52) U.S. Cl.
CPC ..... *H04R 19/04* (2013.01); *H04R 2201/003* (2013.01)

(58) Field of Classification Search
CPC .... B81B 2201/0257; B81B 2203/0127; B81B 2201/025; B81B 2201/0264; B81B 2207/012; B81B 3/0021; B81B 3/0094; B81B 7/0016; B81B 7/0029; B81B 7/0061; B81B 7/02; H04R 19/005; H04R 19/04
USPC ..... 381/174–177
See application file for complete search history.

(56) References Cited

U.S. PATENT DOCUMENTS

2007/0154040 A1* 7/2007 Chen ..... H04R 19/04 381/174
2016/0219375 A1* 7/2016 Hall ..... H04R 17/02

* cited by examiner

*Primary Examiner* — Matthew Eason
*Assistant Examiner* — Julie X Dang
(74) *Attorney, Agent, or Firm* — Na Xu; IPro, PLLC

(57) ABSTRACT

A microphone includes a conducting vibrating diaphragm; a back plate opposed to the vibrating diaphragm and including a plurality of through holes; a first electrode formed in a middle of the back plate; a second electrode formed at an edge of the back plate; and a support portion located between the first electrode and the second electrode for supporting the vibrating diaphragm when the vibrating diaphragm is electrified. When the sound pressure is applied in the middle of the vibrating diaphragm and drives the vibrating diaphragm to deform, the middle of the vibrating diaphragm moves relative to the first electrode, and the edge of the vibrating diaphragm moves relative to the second electrode, at this time, the first electrode and the second electrode generate reversed electric signals.

5 Claims, 1 Drawing Sheet

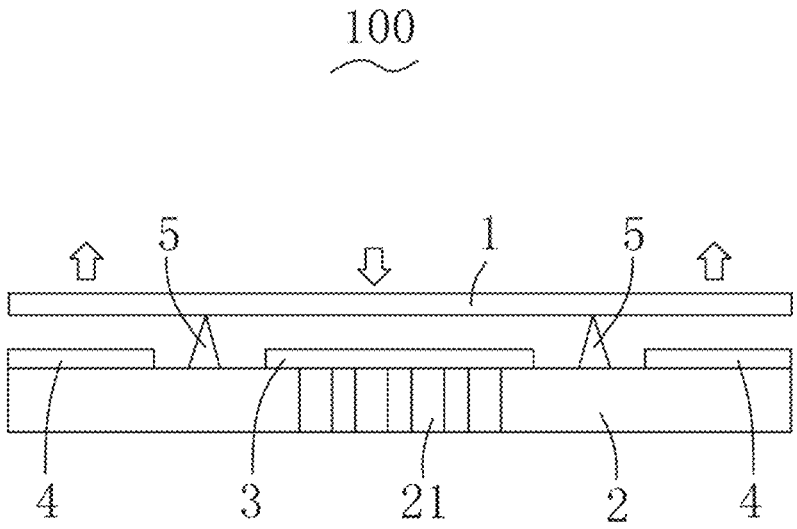
100
5
1
5
4
3
21
2
4

MICROPHONE

FIELD OF THE PRESENT DISCLOSURE

The present disclosure relates to the technical field of electroacoustic transducers, and more particularly to a micro-electro-mechanical system (MEMS) microphone.

DESCRIPTION OF RELATED ART

The traditional microphone is provided with two back plates and one diaphragm (three-layer capacitor structure, and both back plates need to be provided with a conduction layer and anti-stuck layer. The microphone with such a structure has complicated structure and higher costs.

Thereof, it is necessary to disclose and provide an improved microphone to overcome the above-mentioned disadvantages.

BRIEF DESCRIPTION OF THE DRAWING

Many aspects of the exemplary embodiment can be better understood with reference to the following drawing. The components in the drawing are not necessarily drawn to scale, the emphasis instead being placed upon clearly illustrating the principles of the present disclosure.

FIG. 1 is an illustrative cross-sectional view of a microphone in accordance with an exemplary embodiment of the present disclosure.

DETAILED DESCRIPTION OF THE EXEMPLARY EMBODIMENT

The present disclosure will hereinafter be described in detail with reference to n exemplary embodiment. To make the technical problems to be solved, technical solutions and beneficial effects of the present disclosure more apparent, the present disclosure is described in further detail together with the figure and the embodiment. It should be understood the specific embodiment described hereby are only to explain this disclosure, not intended to limit this disclosure.

Referring to FIG. 1, a microphone in accordance with an exemplary embodiment of the present disclosure comprises a conducting vibrating diaphragm 1, a back plate 2 opposed to the conducting vibrating diaphragm 1 and having a plurality of through holes 21, a first electrode 3 disposed at a middle of the back plate 2, a second electrode 4 disposed at an edge of the back plate 2, and a support portion 5 located in an insulation gap formed between the vibrating diaphragm 1 and the back plate 2. Optionally, the support portion 5 is located between the first electrode 3 and the second electrode 4. A plurality of openings is provided in the first electrode 3 for cooperating with the through holes 21 in the back plate.

In this embodiment, the support portion 5 is a continuously closed ring structure, or includes separated columns. Alternatively, the support portion 5 can also be disposed on the vibrating diaphragm 1 according to actual requirements.

In this embodiment, in order to reduce the air damping and improve the sensitivity of the vibrating diaphragm, the vibrating diaphragm 1 could also include a plurality of holes formed at an edge thereof. In addition, the vibrating diaphragm 1 is formed from conducting material. Of course, the vibrating diaphragm 1 can also be provided with conducting glue at one side thereof facing the back plate.

When the vibrating diaphragm 1 is electrified, the vibrating diaphragm 1 is absorbed by the static and supported by the support portion 5, at this time, the vibrating diaphragm 1 and the back plate 2 are parallel with each other; when the sound pressure (sound wave) is applied in the middle of the vibrating diaphragm 1 via the back plate 2 and drives the vibrating diaphragm 1 to be deformed, the middle of the vibrating diaphragm 1 moves relative to the first electrode 3, i.e. the middle portion of the vibrating diaphragm is near or away from the first electrode 3, and the edge of the vibrating diaphragm 1 moves relative to the second electrode 4, i.e. the edge of the vibrating diaphragm is away from or near the second electrode 4, thus, the first electrode 3 and the second electrode 4 generate opposite (reversed) electric signals.

For a microphone provided with the above-mentioned structure, under the action of the sound pressure, due to simultaneous force applied on both sides and in the middle of the vibrating diaphragm, the moments of force are offset mutually, the vibrating diaphragm will not absorb the diaphragm, even if working under the higher bias working voltage, so that the sensitivity of the microphone is improved effectively. In addition, the design of this structure also keeps the anti-interference characteristics of the traditional microphone, and makes the process simpler and reduces the production costs effectively.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A microphone, comprising:

a conducting vibrating diaphragm;

a back plate opposed to the vibrating diaphragm and including a plurality of through holes;

a first electrode formed in a middle of the back plate;

a second electrode formed at an edge of the back plate;

a support portion located in an insulation gap formed between the vibrating diaphragm and the back plate, the support portion being located between the first electrode and the second electrode for supporting the vibrating diaphragm when the vibrating diaphragm is electrified;

when the vibrating diaphragm is electrified, the vibrating diaphragm absorbed by an electrostatic force and supported by the support portion, the vibrating diaphragm parallel to the back plate;

when the sound pressure is applied in the middle of the vibrating diaphragm and drives the vibrating diaphragm to the deformed, the middle of the vibrating diaphragm moving along a direction relative to the first electrode, and the edge of the vibrating diaphragm moving along an opposite direction relative to the second electrode, the first electrode and the second electrode generating reversed signals.

2. The microphone as described in claim 1, wherein the support portion is a continuously closed ring structure, or includes separated columns.

3. The microphone as described in claim 1, wherein the vibrating diaphragm is made from conducting material.

4. The microphone as described in claim 1, wherein the vibrating diaphragm includes conducting glue formed on a surface of the diaphragm facing the back plate.

5. The microphone as described in claim 1, wherein the first electrode includes a plurality of opening formed therethrough.

* * * * *